United States Patent [19]

Kalka

[11] Patent Number: 4,882,953

[45] Date of Patent: Nov. 28, 1989

[54] SKI SHARPENER

[76] Inventor: Donald M. Kalka, P.O. Box 94, Lakeview, Mich. 48850

[21] Appl. No.: 288,765

[22] Filed: Dec. 22, 1988

[51] Int. Cl.[4] ..... B21K 17/00

[52] U.S. Cl. ..... 76/83; 76/88; 51/205 WG

[58] Field of Search ..... 76/82, 83, 88, 82.1, 76/82.2; 51/205 WG; 280/809; 30/286, 287, 294; 29/76 R, 78, 80

[56] References Cited

U.S. PATENT DOCUMENTS 3,621,571 11/1971 Gern .
3,670,601 6/1972 Weeks .
3,766,649 10/1973 Winbauer ..... 30/287
4,347,766 9/1982 Heinlein .

*Primary Examiner*—Roscoe V. Parker
*Attorney, Agent, or Firm*—Waters, Morse & Harrington

[57] ABSTRACT

This device is adapted to sharpen the steel edge strips of a ski by being drawn along the ski while pressing the device gently against the bottom and edge. A standard cutting insert of extremely hard alloy is mounted at the end of the apex of an angular block in such position that a cutting edge intersects the plane of an innerface of the block. The insert is held in cutting position by the engagement of the adjacent block face with the ski edge.

3 Claims, 2 Drawing Sheets

SKI SHARPENER

BACKGROUND OF THE INVENTION

Modern skis are often provided with steel strips along the edges of the bottom surfaces to prevent the edges from rounding over from abrasion and wear. Skiing on hardpacked or icy surfaces often requires that the edge of the ski bite in, if the skier is to retain any control at all. Even these steel insert strips are eventually subject to wear, and are commonly sharpened occasionally with a file to present a sharp edge at the junction of the bottom and side surfaces. The present invention provides a simple and inexpensive device for performing this operation with a much improved uniformity.

SUMMARY OF THE INVENTION

In the preferred form of this invention, an angular block has a base providing a guide surface on the inside of the angle, intended to slide along the bottom of the ski. A wall substantially perpendicular to the surface is positioned to slide along the edge to be sharpened. A standard cutting insert of extremely hard alloy is mounted in a recess at the end of the junction of the base and the wall, with a cutting edge intersecting the plane of the guide surface. The insert is oriented to present the cutting edge in cutting position when the block is pressed gently against the bottom and edge of the ski.

DESCRIPTION OF THE PREFERRED EMBODIMENTS

Figure 1:
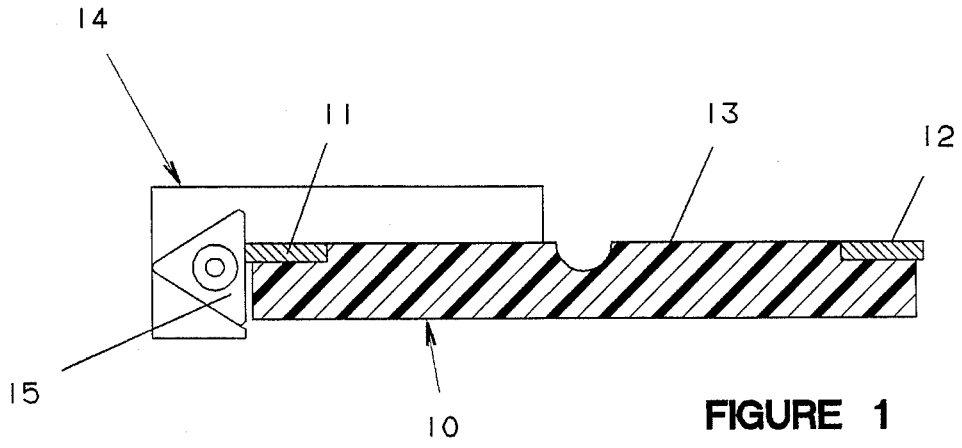
FIG. 1 is a cross section through a standard ski, with the device in position to trim one of the metal edge strips.
Figure 2:
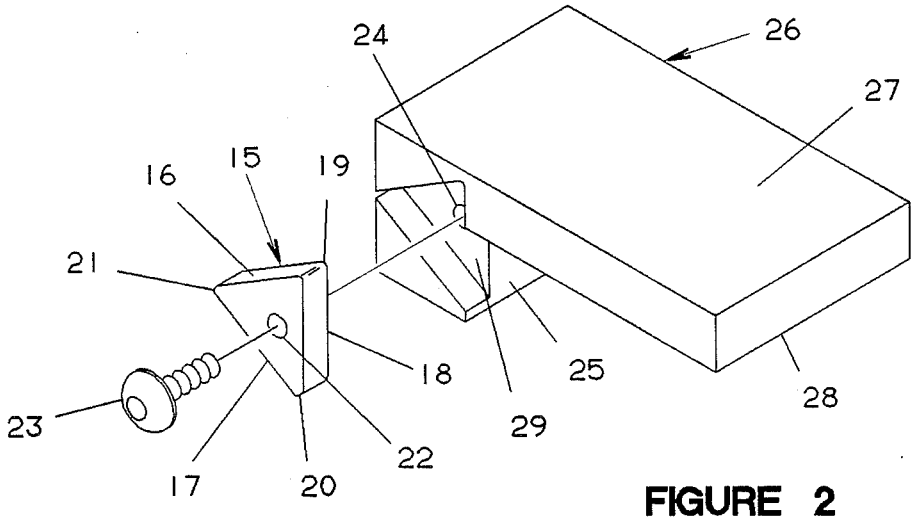
FIG. 2 is an exploded view in perspective showing the components of the device.

Referring to FIGS. 1 and 2, the standard ski 10 is shown provided with the steel edge strips 11 and 12 at the sides of the bottom surface 13. The sharpening device 14 is shown in position to trim the outer edge surface of the insert 11. The device is moved manually along the edge of the ski as the trimming operation proceeds. The bottom surfaces of the inserts 11 and 12 can also be trimmed, with the device 14 re-oriented so that the cutting insert 15 rides along the bottom surface. The wall 25 is kept fairly short so that cutting pressure will then be confined to the steel strip, and not cause the device to dig into the bottom surface 13 of the ski.

The insert 15 is a standard unit (usually Tungsten carbide) of the type used in lathe tools, and has a generally triangular configuration defined by the straight sides 16–18 and the rounded corners 19–21. A central hole 22 receives the insert-holding screw 23 engaging the threaded hole 24 in the wall 25 of the angular block 26. The block has a base 27 providing a guide surface 28 on the inside of the angle. A recess 29 is formed in the block at the end of the junction of the wall 25 and the base 27, the recess being just slightly larger than the insert 15 to position the insert accurately with respect to the guide surface 28 and the wall 25. The insert is placed so that one of the edges 16–18 intersects the plane of the guide surface 28, as shown in FIG. 1.

Figure 3:
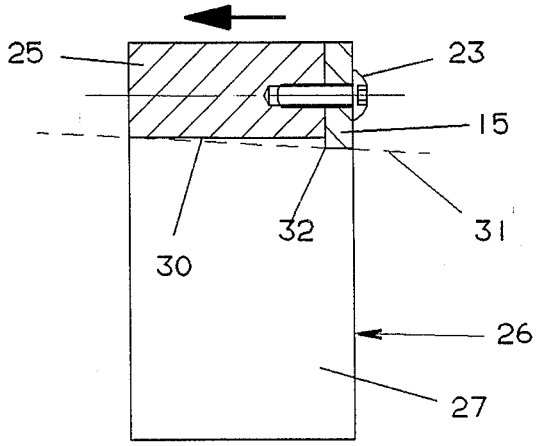
FIG. 3 is a section on a plane parallel to the guide surface of the block, through the axis of the screw holding the cutting insert in position.
Figure 4:
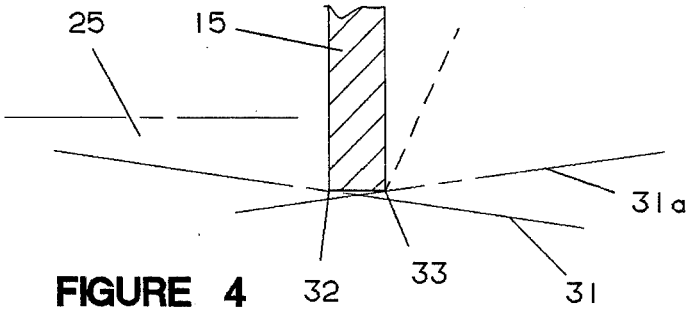
FIG. 4 is a schematic view illustrating alternative cutting positions of the insert.

The edges 16–18 of the insert 15 are normally substantially perpendicular to the face pressed against the base of the recess 29, which forms the insert-receiving surface. This surface positions the insert for proper cutting action. The device has two alternative cutting positions. One of these is shown in FIG. 3. Regardless of which of the three cutting edges of the insert is selected for use, the position of the recess places the insert so that the selected edge extends beyond the innerface of the wall 25. With the instrument placed against the ski as shown in FIG. 1, the left extremity of the wall 25, as shown in FIG. 3, provides a contact surface in the general area indicated at 30, so that the device bears against the steel strip at this point and at the cutting insert, producing a slight angular relationship to the plane of the edge of the ski. This plane is indicated at 31 in FIG. 3. This angular relationship between the edge and the wall 25 slightly rotates the insert in a counter clockwise direction, so that the portion 32 of the edge can dig in to perform the cutting action. This presumes that the plane of the base of the recess 29 is perpendicular to the wall 25. When the frame 26 is machined from solid material, this relationship of the insert and the block is most easily maintained without the use of special holding fixtures. Without the angular relationship of the line 31 to the wall 25, the broad surface of the edge of the insert 15 would be riding along the ski edge strip, and could not perform any cutting action. This relationship is shown more clearly in the schematic diagram of FIG. 4. An alternative cutting position is shown in dotted lines in FIG. 4, in which the device can be rotated clockwise, as viewed in FIG. 3, through an angle sufficient to present the portion 33 to the ski strip in cutting position. This is somewhat difficult to maintain manually. For this reason, it is not recommended. An excessive angle of rotation interferes with the cutting action, and also tends to produce problems where the insert happens to engage a point along the ski strip where any serious abrasion may have taken place. When the device is used in the position shown in dotted lines in FIG. 4, the movement is from left to right along the line **31*a*, while the movement in the FIG. 3** position is from right to left, as indicated by the arrow.

Figure 5:
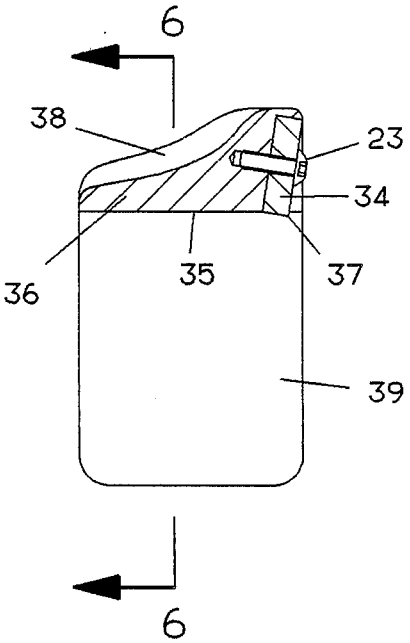
FIG. 5 is a section through the axis of the insertholding screw in a modified form of the invention.
Figure 6:
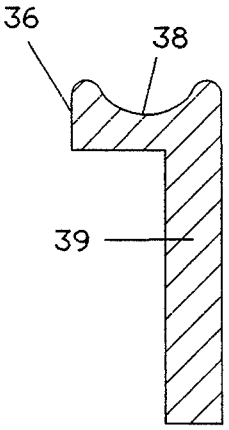
FIG. 6 is a section on the plane 6—6 of FIG. 5.
Figure 7:
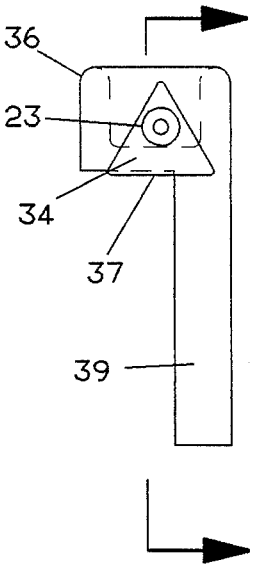
FIG. 7 is an end view with respect to FIG. 5.

In the modification of the invention shown in FIGS. 5–7, the cutting position of the insert is established by the angular relationship of the base of the recess receiving the insert 34 to the surface 35 of the wall 36. The device illustrated in FIG. 5 is intended for movement from left to right, and has the advantage that chips curling from the cutting edge 37 are continually pushed in front of the device, rather than accumulating underneath the wall of the block in the arrangement shown in FIG. 3. In FIG. 5, the formation of the insert recess has the effect of rotating the insert slightly clockwise from being perpendicular to the surface 35. In the modification of the invention shown in FIGS. 5–7, the angular block is preferably molded of plastic material. The outer surface 38 of the wall 36 is preferably contoured to receive the thumb of the user during the manipulation of the device. This has the desirable side effect of reducing the amount of material in the block. The base 39 is similar in configuration to that previously described.

Figure 8:
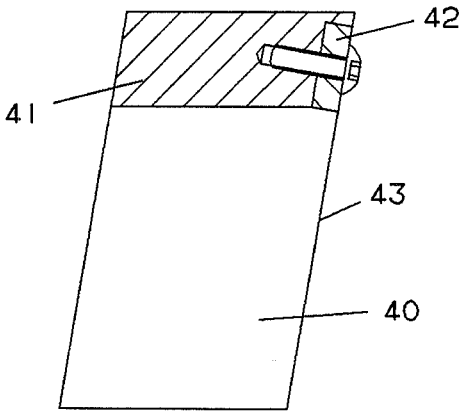
FIG. 8 is a section through the axis of the insertholding screw in a further modification of the invention.

The modification shown in FIG. 8 functions in a manner similar to that shown in FIG. 5. The construction appearing in FIG. 8 is appropriate when the block is cut from extruded material to produce the angular relationship between the base 40 and the wall 41. The recess receiving the insert 42 can thus be machined parallel to the edge 43, without special holding equipment. Where a substantial quantity of these devices is to be manufactured, the use of the holding equipment necessary to establish the angular relationship between the base of the recess and the edges of the block is usually more than justified, in which case the extrusion can be cut on planes perpendicular to the edges of the extrusion.

I claim:

1. An edge-sharpening device, comprising:

a unitary block forming an angular frame providing a guide surface and a wall disposed at an angle to said guide surface, said frame having a recess in an end of said wall adapted to receive a standard cutting insert providing at least one cutting edge, said recess positioning said insert so that said cutting edge intersects the plane of said guide surface.

2. A device as defined in claim 1, wherein said recess is triangular, and said wall is provided with a threaded hole disposed on an axis intersecting the central portion of said recess.

3. A device as defined in claim 2 wherein said standard cutting insert received in said recess is secured therein by a screw engaging said threaded hole.

* * * * *